US011708942B2

(12) United States Patent
Nakamoto et al.

(10) Patent No.: US 11,708,942 B2
(45) Date of Patent: Jul. 25, 2023

(54) GAS FILLING METHOD AND GAS FILLING APPARATUS

(71) Applicant: PACRAFT Co., Ltd., Tokyo (JP)

(72) Inventors: Kakue Nakamoto, Yamaguchi-ken (JP); Tohru Yoshikane, Yamaguchi-ken (JP)

(73) Assignee: PACRAFT CO., LTD., Tokyo (JP)

( * ) Notice: Subject to any disclaimer, the term of this patent is extended or adjusted under 35 U.S.C. 154(b) by 71 days.

(21) Appl. No.: 17/329,798

(22) Filed: May 25, 2021

(65) Prior Publication Data

US 2021/0372567 A1 Dec. 2, 2021

(30) Foreign Application Priority Data

May 28, 2020 (JP) ..... 2020-093455

(51) Int. Cl.
*F17C 5/06* (2006.01)

(52) U.S. Cl.
CPC ..... *F17C 5/06* (2013.01); *F17C 2203/0685* (2013.01); *F17C 2205/0311* (2013.01); *F17C 2221/031* (2013.01)

(58) Field of Classification Search
CPC ..... F17C 5/06; F17C 2203/0685; F17C 2205/0311; F17C 2221/031
See application file for complete search history.

(56) References Cited

U.S. PATENT DOCUMENTS

2014/0182244 A1* 7/2014 Kawamura ..... B65B 31/048 53/284.7
2018/0050512 A1* 2/2018 Borgström ..... B31B 70/008

FOREIGN PATENT DOCUMENTS

| | | | |
|---|---|---|---|
| CN | 109641687 | A | 4/2019 |
| EP | 0397249 | A1 | 11/1990 |
| EP | 3492403 | A1 | 6/2019 |
| JP | 2006-123931 | A | 5/2006 |
| JP | 2015-024855 | A | 2/2015 |
| WO | 2008/016963 | A2 | 2/2008 |

OTHER PUBLICATIONS

Extended European Search Report dated Oct. 20, 2021, issued in corresponding European Patent Application No. 21175357.9 (7 pgs.).

* cited by examiner

*Primary Examiner* — Jason K Niesz
(74) *Attorney, Agent, or Firm* — Pillsbury Winthrop Shaw Pittman, LLP

(57) ABSTRACT

A gas filling method includes the steps of: intermittently transferring a bag to arrange the bag at a gas blowing processing position; inserting a blowing nozzle into a gas guide path of the bag in the gas blowing processing position; pinching the blowing nozzle arranged in the gas guide path from outside of the bag with a pair of pinching members in the gas blowing processing position; causing the blowing nozzle to eject the gas in such a manner that the gas is sent to the gas accommodation portion in the gas blowing processing position in a state where the blowing nozzle is pinched via the bag by the pair of pinching members; and closing the gas accommodation portion in an airtight manner in the gas blowing processing position in a state where the blowing nozzle is arranged in the gas guide path.

10 Claims, 7 Drawing Sheets

GAS FILLING METHOD AND GAS FILLING APPARATUS

CROSS-REFERENCE TO RELATED APPLICATIONS

This application is based upon and claims the benefit of priority from Japanese Patent Application No. 2020-93455, filed on May 28, 2020; the entire contents of which are incorporated herein by reference.

TECHNICAL FIELD

The present disclosure is directed to a gas filling method and a gas filling apparatus.

BACKGROUND ART

A bag comprising a gas accommodation portion to be filled with a gas in addition to a content accommodation portion to be filled with contents is known.

For example, a self-support pouch disclosed in Japanese patent application publication No. 2015-24855 includes a storage portion to be filled with contents and an air layer in which an air is enclosed. With this air layer, the shape of the entire pouch is not easily deformed, the pouch easily maintains its self-support performance, and it is also possible to utilize a portion near the air layer as a handle.

SUMMARY OF INVENTION

Technical Problem

In a bag having both a content accommodation portion and a gas accommodation portion, it is desirable to carry out a process for enclosing an air in the gas accommodation portion in a swift and reliable manner.

Bags comprising a content accommodation portion and a gas accommodation portion are not limited to a form of a self-support pouch as disclosed in Japanese patent application publication No. 2015-24855. Bags may comprise a content accommodation portion and a gas accommodation portion in various forms. Therefore, a gas filling method and a gas filling apparatus that are widely applicable to bags comprising various forms of content accommodation portions and gas accommodation portions, are useful. Bags suitable for enclosing a gas in the gas accommodation portion are also useful.

The present disclosure has been contrived in view of the above circumstances and an object thereof is to provide an apparatus and a method which are capable of swiftly and reliably enclosing a gas in a gas accommodation portion of a bag including a content accommodation portion and the gas accommodation portion.

Solution to Problem

An aspect of the present disclosure is directed to a gas filling method of enclosing a gas in a gas accommodation portion of a bag comprising a content accommodation portion and the gas accommodation portion, the gas filling method including the steps of: transferring the bag in an intermittent manner to arrange the bag at a gas blowing processing position; inserting a blowing nozzle into a gas guide path of the bag in the gas blowing processing position, the gas guide path being communicated with the gas accommodation portion; pinching the blowing nozzle arranged in the gas guide path from outside of the bag with a pair of pinching members in the gas blowing processing position; causing the blowing nozzle to eject the gas in a state where the blowing nozzle is pinched via the bag by the pair of pinching members in the gas blowing processing position in such a manner that the gas is sent to the gas accommodation portion; and closing the gas accommodation portion in an airtight manner in the gas blowing processing position in a state where the blowing nozzle is arranged in the gas guide path.

The blowing nozzle may be inserted into the gas guide path while movement of a film member of the bag that forms the gas guide path is restricted by a restricting member.

Another aspect of the present disclosure is directed to a gas filling apparatus that encloses a gas in a gas accommodation portion of a bag including a content accommodation portion and the gas accommodation portion, the gas filling apparatus comprising: a bag transfer mechanism that transfers the bag in an intermittent manner; a blowing nozzle that ejects the gas; a nozzle movement mechanism that arranges the blowing nozzle at a nozzle evacuation position and at a nozzle blowing position, the blowing nozzle arranged at the nozzle evacuation position being not located in a gas guide path communicated with the gas accommodation portion of the bag, the blowing nozzle arranged at the nozzle blowing position being located in the gas guide path; a pair of pinching members; a pinching movement mechanism that arranges the pair of pinching members at a pinching evacuation position and at a pinching support position, the pair of pinching members arranged at the pinching evacuation position not supporting the blowing nozzle located in the gas guide path from outside of the bag, the pair of pinching members arranged at the pinching support position pinching and supporting the blowing nozzle located in the gas guide path from outside of the bag; a closure device that closes the gas accommodation portion in an airtight manner; and a restricting member that restricts movement of a film member of the bag forming the gas guide path.

The blowing nozzle may have a tip portion with a flat shape.

The gas filling apparatus may comprise a closure movement mechanism that moves the closure device to an airtight closure position and to a closure evacuation position, the closure device arranged in the airtight closure position being in contact with the bag to close the gas accommodation portion in an airtight manner, the closure device arranged in the closure evacuation position being distanced from the bag not to close the gas accommodation portion in an airtight manner.

The bag may include: a main body portion; and a protruding portion protruding from the main body portion, the main body portion may include: the content accommodation portion; the gas accommodation portion; and a content guide path that is communicated with an outside and the content accommodation portion, and the protruding portion may include the gas guide path communicated with an outside and the gas accommodation portion.

According to the present disclosure, a gas can be swiftly and reliably enclosed in a gas accommodation portion of a bag including a content accommodation portion and the gas accommodation portion.

DESCRIPTION OF EMBODIMENTS

Figure 1:
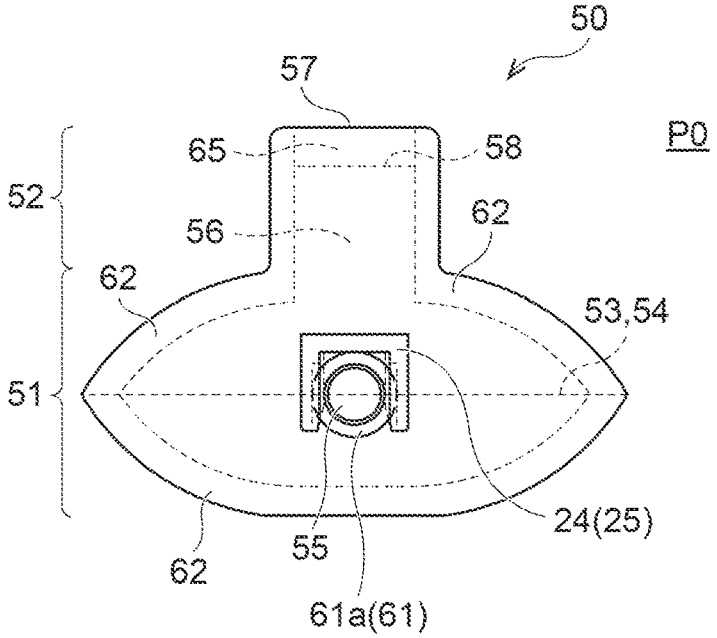
FIG. 1 is a plan view showing an example of a bag arranged at a pre-stage processing position.
Figure 2:
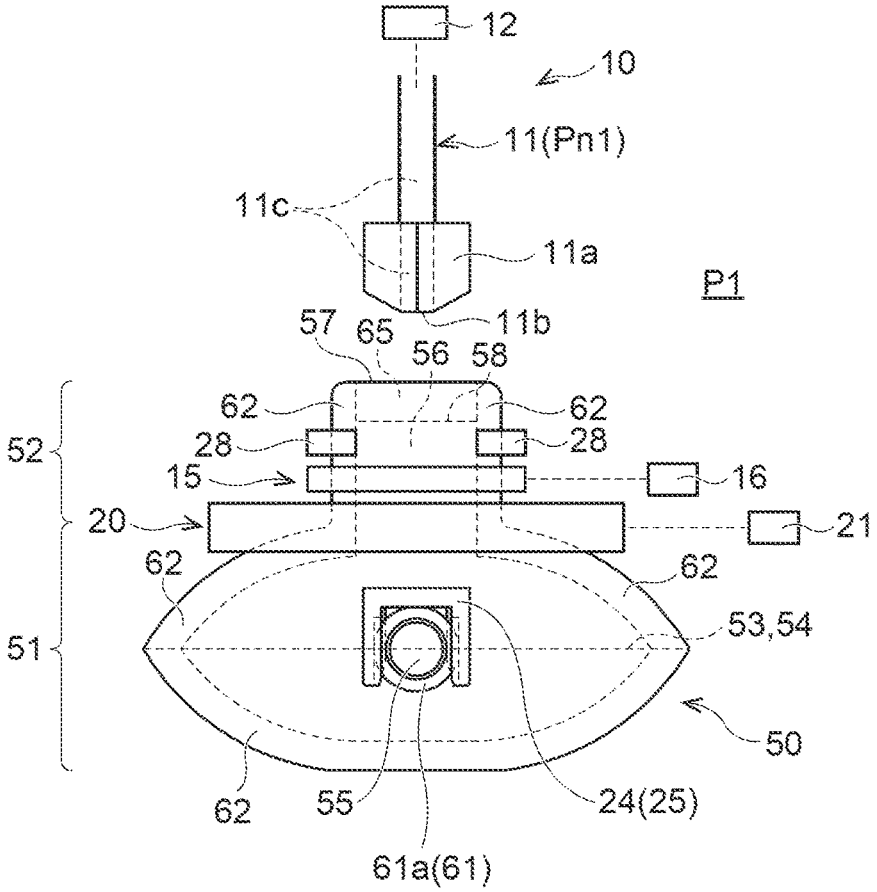
FIG. 2 is a plan view showing an example of a bag arranged at a gas blowing processing position.

FIG. 1 is a plan view showing an example of a bag 50 arranged at a pre-stage processing position P0. FIG. 2 is a plan view showing an example of a bag 50 arranged at a gas blowing processing position P1. FIGS. 3 to 11 are diagrams which show a schematic configuration of a bag 50 and a gas filling apparatus 10 arranged at the gas blowing processing position P1 and explain an example of a gas filling method. In FIGS. 1 and 2, the near side with respect to the paper surface corresponds to the upper side of the actual gas filling apparatus 10 and an actual bag 50; the far side with respect to the paper surface corresponds to the lower side of the actual gas filling apparatus 10 and an actual bag 50; and a direction parallel to the paper surface corresponds to a horizontal direction with respect to the actual gas filling apparatus 10 and an actual bag 50. In FIGS. 3 to 11, the left side of the paper surface corresponds to the upper side of the actual gas filling apparatus 10 and an actual bag 50; the right side of the paper surface corresponds to the lower side of the actual gas filling apparatus 10 and an actual bag 50; and vertical direction of the paper surface and the direction perpendicular to the paper surface correspond to horizontal directions of the actual gas filling apparatus 10 and an actual bag 50.

In this description, unless otherwise specified, a horizontal direction means a direction forming a right angle to the vertical direction on which gravity acts, and a vertical direction means a direction forming a right angle to a horizontal direction.

Bags

A bag 50 includes a main body portion 51 and a protruding portion 52 protruding from the main body portion 51. In a bag 50 shown in drawings, the main body portion 51 extends substantially in a vertical direction as a whole, and the protruding portion 52 extends in a horizontal direction as a whole.

The main body portion 51 includes: a front side film member 57 and a rear side film member 58 arranged so as to face each other; and a spout 61. The spout 61 is to be held by a bag holding member 24 which forms a part of a bag transfer mechanism 25. The spout 61 shown in drawings has an annular collar 61*a* extending in a horizontal direction, and the bag 50 is held by the bag holding member 24 in a suspended manner by causing the collar 61*a* to be inserted horizontally into the bag holding member 24. Then, the bag 50 is moved together with the bag holding member 24 by the bag transfer mechanism 25. The bag transfer mechanism 25 of the present embodiment intermittently transfers the bag 50 so as to arrange the bag 50 sequentially at a plurality of processing positions including the pre-stage processing position P0 (see FIG. 1) and the gas blowing processing position P1 (see FIG. 2).

The protruding portion 52 has a front side film member 57 located on the upper side and a rear side film member 58 located on the lower side, and the front side film member 57 and the rear side film member 58 are arranged so as to face each other. In the protruding portion 52 shown in drawings, a single front side film member 57 and a single rear side film member 58 are arranged so as to face each other and are joined to each other at both side edges. In the present embodiment, one of the front side film member 57 and the rear side film member 58 protrudes compared to the other in at least a part of the tip portion on the outer side of the protruding portion 52. In the example show in drawings, of the tip portion on the outer side of the rear side film member 58 forming the protruding portion 52, a portion other than both side edge portions (that is, an edge seal portions 62) is cut out in a quadrangular shape, and this cutout part forms a notch portion 65. Therefore, the front side film member 57 protrudes from the rear side film member 58 at a part corresponding to the notch portion 65.

In the main body portion 51 and the protruding portion 52 of a bag 50, the front side film member 57 and the rear side film member 58 arranged so as to face each other are joined to each other at edge portions, and the joined edge portions form edge seal portions 62. In this regard, however, the front side film member 57 and the rear side film member 58 are not joined to each other in at least a part of the outer side edge portion of the protruding portion 52 in such a manner that an operable and closable opening section 68 (see FIG. 4) of a gas guide path 56 is formed. The joining method for forming the edge seal portions 62 is not limited. For example, the front side film member 57 and the rear side film member 58 may be joined via another member, such as an adhesive, or may be directly joined by thermocompression bonding or the like.

The main body portion 51 includes: a content accommodation portion 53 in which contents are to be accommodated; at least a part of a gas accommodation portion 54 in which a gas is to be accommodated; and a content guide path 55 communicated with the outside and the content accommodation portion 53. The protruding portion 52 has a gas guide path 56 that is communicated with the outside and the gas accommodation portion 54. The content accommodation portion 53, the gas accommodation portion 54 and the gas guide path 56 are formed by spaces between the front side film member 57 and the rear side film member 58. The content guide path 55 is formed by a through hole included in the spout 61.

In a bag 50 shown in drawings, the content accommodation portion 53 is covered from the outside with the gas accommodation portion 54. As shown in FIGS. 7 to 11, in a portion of the main body portion 51 where the content accommodation portion 53 and the gas accommodation portion 54 are stacked on top of each other, the front side film member 57 includes an inner front side film member 57*a* and an outer front side film member 57*b*, and the rear side film member 58 includes an inner rear side film member 58*a* and an outer rear side film member 58*b*. The inner front side film member 57*a* and the inner rear side film member 58*a* are arranged so as to face each other and are joined to each other at edge portions. The outer front side film member 57*b* and the outer rear side film member 58*b* are arranged, on the outside of the inner front side film member 57*a* and the inner rear side film member 58*a*, so as to face each other and are joined to each other at edge portions. The inner front side film member 57*a* may or may not be joined to the outer front side film member 57*b*. The inner rear side film member 58*a* may or may not be joined to the outer rear side film member 58*b*.

The content accommodation portion 53 is partitioned by the inner front side film member 57*a* and the inner rear side film member 58*a*. The inner front side film member 57*a* and the inner rear side film member 58*a* are joined to a spout 61 in an airtight manner, and the through hole (that is, the content guide path 55) of the spout 61 is communicated with the content accommodation portion 53. On the other hand, a part of the gas accommodation portion 54 is partitioned by the inner front side film member 57*a*, the outer front side film member 57*b*, the inner rear side film member 58*a* and the outer rear side film member 58*b*, and is arranged so as to be adjacent to the content accommodation portion 53 via the inner front side film member 57*a* and the inner rear side film member 58*a*. The outer front side film member 57*b* and the outer rear side film member 58*b* are connected to the rear side film member 58 of the protruding portion 52. The gas accommodation portion 54 is communicated with the gas guide path 56 but is not communicated with the content accommodation portion 53.

Gas Filling Apparatus

The gas filling apparatus 10 encloses a gas in the gas accommodation portion 54 of the above-mentioned bag 50 positioned at the gas blowing processing position P1 (see FIG. 2).

The gas filling apparatus 10 of the present embodiment includes a blowing nozzle 11, a nozzle movement mechanism 12, a pair of pinching members 15, a pinching movement mechanism 16, and a closure device 20.

The blowing nozzle 11 ejects gas. Specifically, the blowing nozzle 11 includes a nozzle tip portion 11*a*, a nozzle ejection port 11*b* formed in the nozzle tip portion 11*a*, and a nozzle air passage 11*c* being communicated with the nozzle ejection port 11*b*. A gas supplied to the blowing nozzle 11 is sent to the nozzle ejection port 11*b* via the nozzle air passage 11*c* and is ejected from the nozzle ejection port 11*b*. The gas ejected from the blowing nozzle 11 is not limited, and for example, air, inert gas (nitrogen or the like), carbon dioxide, or other gas is ejected from the blowing nozzle 11. The blowing nozzle 11 may continue to eject gas while the gas filling apparatus 10 is operating, or the ejection of gas from the blowing nozzle 11 may be switched on and off according to the position where the blowing nozzle 11 is arranged and/or other conditions. Further, the pressure of the gas ejected from the blowing nozzle 11 may be basically constant or may be changed. In the present embodiment, the pressure of the gas ejected from the blowing nozzle 11 can be switched between a first regulation gas pressure which is a relatively high pressure and a second regulation gas pressure which is a relatively low pressure.

The nozzle tip portion 11*a* of the present embodiment has a flat shape. Specifically, the nozzle tip portion 11*a* has a width direction size (i.e., a size in the left and right direction in the paper surface of FIG. 2) larger than a vertical size (i.e., a size in the direction perpendicular to the paper surface of FIG. 2). The nozzle tip portion 11*a* has a shape and a size such that the nozzle tip portion 11*a* can be inserted into the gas guide path 56 of a bag 50, and the width direction size of the nozzle tip portion 11*a* is smaller than the width direction size of the gas guide path 56. Since the nozzle tip portion 11*a* has a flat shape, a gap which might be formed between a bag 50 and the nozzle tip portion 11*a* can be reduced when the gas is ejected in a state where the nozzle tip portion 11*a* is located in the gas guide path 56 as described later (see FIG. 7), so that the gas blowing efficiency can be maintained high.

The nozzle movement mechanism 12 moves the blowing nozzle 11. The specific configuration of the nozzle movement mechanism 12 is not limited. For example, the nozzle movement mechanism 12 can be configured by an actuator equipped with an electric drive device (such as a solenoid or a motor), an actuator equipped with a pressure device (such as a power cylinder, for example, an air cylinder), or another device. The nozzle movement mechanism 12 of the present embodiment can position the blowing nozzle 11 at a nozzle evacuation position Pn1 and a nozzle blowing position Pn2. The nozzle evacuation position Pn1 is a position where the blowing nozzle 11 is not arranged inside the gas guide path 56 of a bag 50 located at the gas blowing processing position P1 (see FIG. 2). The nozzle blowing position Pn2 is a position where the blowing nozzle 11 is arranged inside the gas guide path 56 of a bag 50 located at the gas blowing processing position P1 (see FIG. 5).

Each pinching member 15 is provided so as to be movable. The protruding portion 52 (including the gas guide path 56) of a bag 50 arranged at the gas blowing processing position P1 is positioned between the pinching members 15. The two pinching members 15 shown in drawings move symmetrically in the vertical direction and are arranged at positions which are equally distant from the nozzle tip portion 11*a* of the blowing nozzle 11 arranged at the nozzle blowing position Pn2. Each of the pinching members 15 shown in drawings has a size in a width direction (i.e., a size in the left and right direction in FIG. 2) larger than that of the protruding portion 52 of a bag 50.

The pair of pinching members 15 pinches and supports the blowing nozzle 11 from the outside of the bag 50 as described later (see FIGS. 6 and 7), so that the gas ejected from the blowing nozzle 11 is efficiently guided into the gas accommodation portion 54. Therefore, it is preferable that the gap between each pinching member 15 and the blowing nozzle 11 be smaller in a state where the pair of pinching members 15 pinches and supports the blowing nozzle 11 from the outside of the bag 50. Therefore, it is preferable that the shape of the support surface of each pinching member 15 match the surface shape of the blowing nozzle 11 (in particular, of the part supported directly by each pinching member 15). However, the shape of the support surface of each pinching member 15 does not necessarily have to match the surface shape of the blowing nozzle 11, and there may be a gap between each pinching member 15 and the blowing nozzle 11 in a state where the pair of pinching members 15 pinches and supports the blowing nozzle 11 from the outside of the bag 50.

The pinching movement mechanism 16 moves each pinching member 15. The specific configuration of the pinching movement mechanism 16 is not limited, and the pinching movement mechanism 16 can be configured by an arbitrary actuator or another device. The pinching movement mechanism 16 of the present embodiment symmetrically moves the two pinching members 15 in the vertical direction in such a manner that each pinching member 15 is positioned at each of a pinching evacuation position Pc1 and a pinching support position Pc2. The pair of pinching members 15 arranged at the pinching evacuation positions Pc1 does not support the blowing nozzle 11 located in the gas guide path 56 from the outside of the bag 50 (see FIG. 5). On the other hand, the pair of pinching members 15 arranged at the pinching support positions Pc2 pinches and supports the blowing nozzle 11 located in the gas guide path 56 from the outside of the bag 50 (see FIGS. 6 to 8).

The closure device 20 closes the gas accommodation portion 54 in an airtight manner. The closure device 20 of the present embodiment is formed by two sealing members provided so as to be movable in the vertical direction. These two sealing members weld the front side film member 57 and the rear side film member 58 to each other in a state where the two sealing members pinch and bring the front side film member 57 and the rear side film member 58 into close contact with each other. As a result, the front side film member 57 and the rear side film member 58 are joined in an airtight manner at the close contact portion (see the "joint part S" shown in FIG. 11) and the communication between the gas accommodation portion 54 and the gas guide path 56 is shut off. The sealing method adopted by the closure device 20 is not limited, and for example, the closure device 20 can adopt an ultrasonic sealing method or a heat sealing method.

The closure movement mechanism 21 moves the closure device 20 (i.e., two sealing members). The specific configuration of the closure movement mechanism 21 is not limited, and the closure movement mechanism 21 can be configured by an arbitrary actuator or another device. The closure movement mechanism 21 of the present embodiment symmetrically moves the two sealing members in the vertical direction in such a manner that each sealing member is positioned at each of a closure evacuation position Ph1 and an airtight closure position Ph2. The pair of sealing members arranged at the closure evacuation position Ph1 is separated from a bag 50 so as not to close the gas accommodation portion 54 in an airtight manner, so that the front side film member 57 and the rear side film member 58 of the protruding portion 52 are not brought into close contact with each other (see FIG. 7). On the other hand, the pair of sealing members arranged at the airtight closure position Ph2 comes into contact with the protruding portion 52 of a bag 50 so as to close the gas accommodation portion 54 in an airtight manner, so that the front side film member 57 and the rear side film member 58 of the protruding portion 52 are brought into close contact with and joined to each other in an airtight manner (see FIG. 8).

Figure 4:
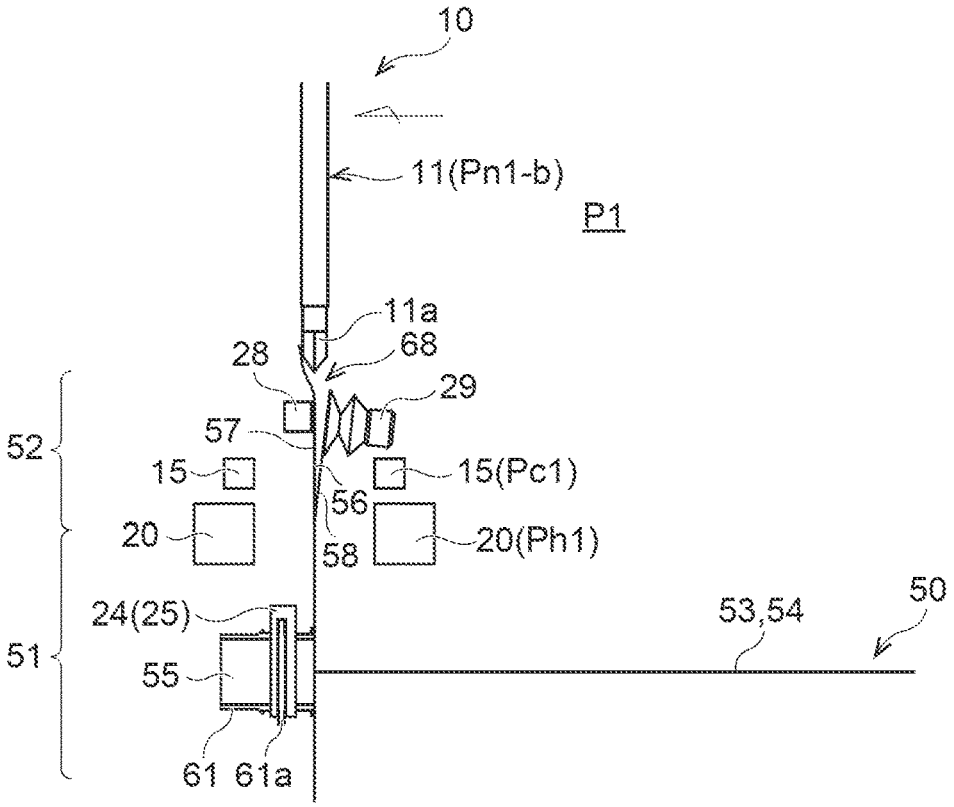
FIG. 4 is a diagram showing an example of a gas filling method.

The gas filling apparatus 10 of the present embodiment further includes a restricting member 28 and an opening device 29 (see FIG. 4).

The restricting member 28 restricts the movement of the film member of a bag 50 which forms the gas guide path 56. The restricting member 28 of the present embodiment is provided at a position facing the front side film member 57 of the protruding portion 52 from above and restricts the upward movement of the front side film member 57. The restricting member 28 shown in drawings includes two fixed members. As shown in FIG. 2, these fixing members are fixedly provided at positions separated in the width direction, can come into contact with edge seal portions 62 of both sides of the protruding portion 52, but do not come into contact with at least a part of the portion of the front side film member 57 which partitions the gas guide path 56.

The restricting member 28 may be provided so as to be movable. In this case, the restricting member 28 may be arranged in a restriction position (i.e., a position of the restricting member 28 shown in FIG. 3 for example) where the restricting member 28 restricts the movement of the film member of a bag 50 which forms the gas guide path 56 and in an evacuation position (not shown in drawings) where the restricting member 28 dose not restrict the movement of the film member. In the gas filling method described later, the restricting member 28 may be arranged at the restriction position only in a step(s) in which the movement of the film member of a bag 50 which forms the gas guide path 56 is required to be restricted, and the restricting member 28 may be arranged at the evacuation position in other steps.

The opening device 29 places the opening section 68 of the gas guide path 56 of a bag 50 in an open condition and maintains the open condition of the opening section 68. The opening device 29 shown in FIG. 4 includes a suction cup which is capable of sucking and holding the rear side film member 58 of the protruding portion 52. The opening device 29 opens the opening section 68 of the gas guide path 56 by causing the suction cup to perform a tilt action while the suction cup sucks and holds the rear side film member 58 of the protruding portion 52 of a bag 50 arranged at the gas blowing processing position P1. The opening device 29 can switch the suction of the suction cup on and off, and by switching off the suction of the suction cup, the suction cup can be separated from the rear side film member 58.

Gas Filling Method

Next, an example of a gas filling method in which a gas is filled in the gas accommodation portion 54 of the above-described bag 50 will be described.

The bag transfer mechanism 25 intermittently transfers a bag 50 to be processed and arranges the bag 50 at the gas blowing processing position P1. Specifically, in a state where a bag 50 to be processed is held by the bag holding member 24, the bag 50 is moved by the bag transfer mechanism 25 from the pre-stage processing position P0 (see FIG. 1) to the gas blowing processing position P1 (see FIG. 2). The bag transfer mechanism 25 may transfer only one bag 50 at a time or may transfer a plurality of bags 50 at a time. For example, the bag transfer mechanism 25 may include a plurality of bag holding members 24 arranged at equal intervals in the horizontal direction, a plurality of bags 50 held by these bag holding members 24 are intermittently moved to a plurality of processing positions, and each bag 50 may be subjected to treatments in the respective processing positions.

Figure 3:
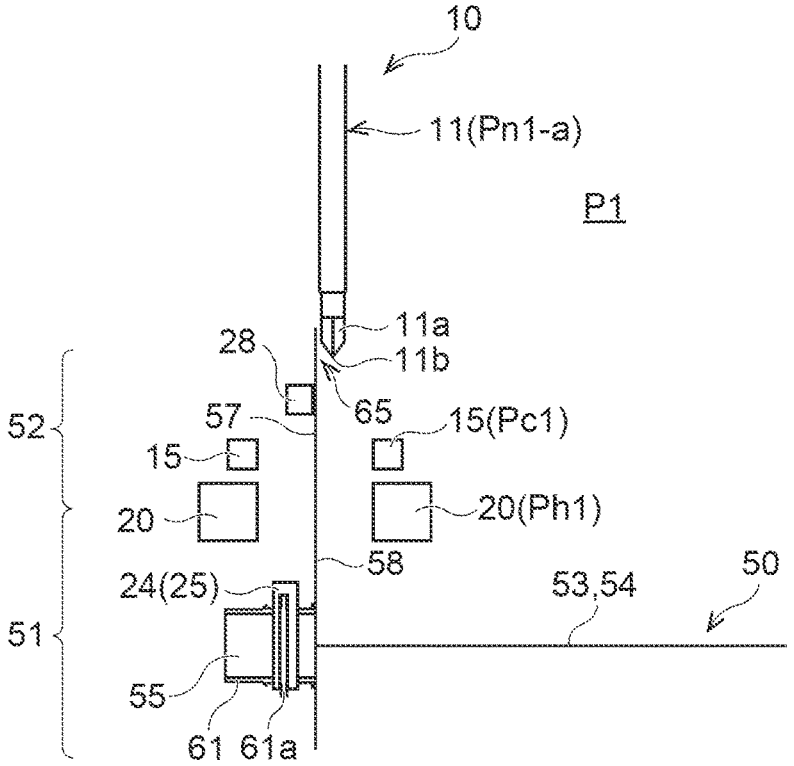
FIG. 3 is a diagram showing an example of a gas filling method.

The blowing nozzle 11 is arranged at a first nozzle evacuation position Pn1-*a* shown in FIG. 3 in a state where a bag 50 is positioned at the gas blowing processing position P1. Thus, the nozzle tip portion 11*a* is arranged at a position where the nozzle tip portion 11*a* basically does not come into contact with the bag 50 (in particular, the protruding portion 52) and faces the front side film member 57 via the notch portion 65.

Then, the blowing nozzle 11 is moved from the first nozzle evacuation position Pn1-*a* and is arranged at a second nozzle evacuation position Pn1-*b* shown in FIG. 4. Thus, while the blowing nozzle 11 (in particular, the nozzle tip portion 11*a*) touches the front side film member 57 (in particular, the portion facing the notch portion 65), the blowing nozzle 11 moves the front side film member 57 (in particular, the portion with which the nozzle tip portion 11*a* comes into contact) in a direction such that the front side film member 57 is moved away from the rear side film member 58 (in the present example, in an upper direction). During this process, the movement of the front side film member 57 is restricted by the restricting member 28. On the other hand, the rear side film member 58 is held by the opening device 29, and the rear side film member 58 (in particular, the part held by the opening device 29) is moved in a direction such that the rear side film member 58 is moved away from the front side film member 57 (in the present example, in a downward direction).

During this process, the arrangement positions of the restricting member 28 and the opening device 29 with respect to the protruding portion 52 are not limited. From the viewpoint of enabling the smooth insertion of the blowing nozzle 11 into the gas guide path 56, it is preferable that the restricting member 28 and the opening device 29 be installed so as to support (that is, to contact) a part of the protruding portion 52 in the vicinity of the opening section 68. The opening device 29 shown in drawings holds a part of the rear side film member 58 which faces the restricting member 28 and is an outer tip portion of the rear side film member 58 of the protruding portion 52.

The blowing nozzle 11 of the present embodiment can eject a gas in the state shown in FIG. 4 and blow the gas to the opening section 68 to promote opening of the opening section 68. As described above, in the present embodiment, the blowing nozzle 11, the restricting member 28 and the opening device 29 integrally perform the respective functions in such a manner that the opening section 68 of the gas guide path 56 is appropriately opened.

Figure 5:
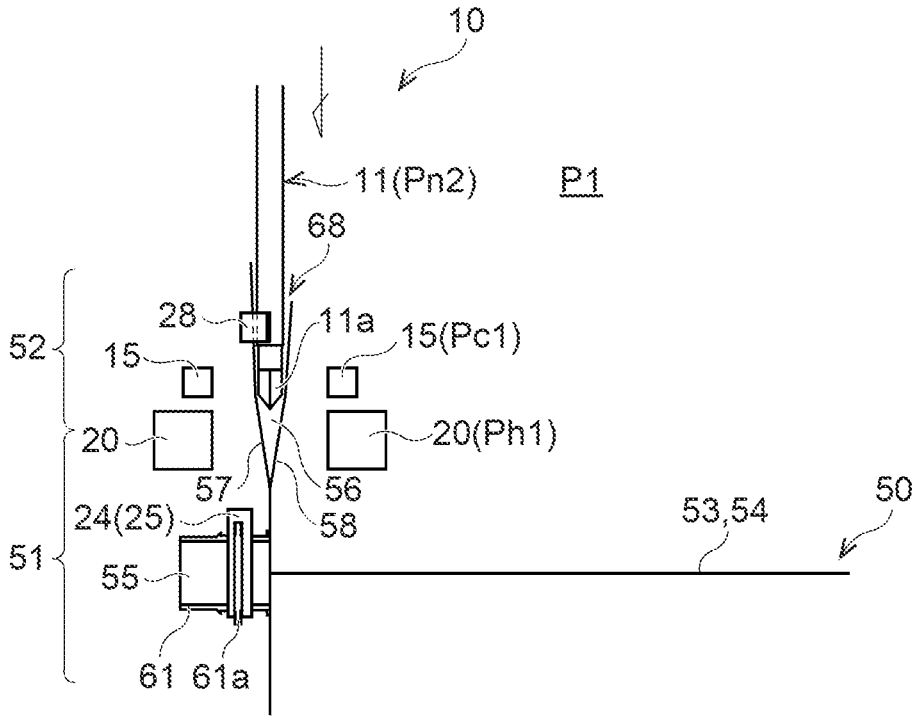
FIG. 5 is a diagram showing an example of a gas filling method.

Then, the blowing nozzle 11 is moved in the horizontal direction from the second nozzle evacuation position Pn1-*b* to be positioned at the nozzle blowing position Pn2 shown in FIG. 5. Thus, the tip end portion (including the nozzle tip portion 11*a*) of the blowing nozzle 11 is inserted into the gas guide path 56, and the nozzle tip portion 11*a* is positioned between the pinching members 15 arranged at the pinching evacuation positions Pc1. In particular, in the present embodiment, the blowing nozzle 11 is inserted into the gas guide path 56 through the opening section 68 while the movement of the film member forming the gas guide path 56 (that is, of the front side film member 57) is restricted by the restricting member 28 in a state where the opening section 68 of the gas guide path 56 is opened by the opening device 29 (see FIG. 4). As a result, in the gas blowing processing position P1, the blowing nozzle 11 is smoothly and surely inserted into the gas guide path 56.

The suction holding of the rear side film member 58 by the opening device 29 is released after a part of the blowing nozzle 11 enters the gas guide path 56. For example, while the blowing nozzle 11 is moving toward the nozzle blowing position Pn2 or after the blowing nozzle 11 is positioned at the nozzle blowing position Pn2, the suction cup of the opening device 29 may release the holding of the rear side film member 58 and may be arranged at an evacuation position (not shown in the drawings).

Further, in the present embodiment, a gas is ejected from the blowing nozzle 11 temporarily or throughout, at least while the blowing nozzle 11 moves from the second nozzle evacuation position Pn1-*b* (see FIG. 4) to the nozzle blowing position Pn2 (see FIG. 5). Thus, the separation between the front side film member 57 and the rear side film member 58 which form the gas guide path 56 is urged, and a traveling space for the blowing nozzle 11 can be secured in the gas guide path 56. In this process, the pressure of the gas ejected from the blowing nozzle 11 is smaller than the pressure of the gas ejected from the blowing nozzle 11 in the step, described later (see FIG. 7), of filling the gas accommodation portion 54 with the gas. By ejecting a gas having a low pressure (that is, the second regulation gas pressure) from the blowing nozzle 11 in this way, the blowing nozzle 11 can be inserted into the gas guide path 56 while it is possible to suppress the excessive fluttering of the front side film member 57 and the rear side film member 58.

By bringing the blowing nozzle 11 closer to the opening section 68 of the gas guide path 56 while a gas is being ejected from the blowing nozzle 11, the opening of the opening section 68 can be promoted. In a case where the opening section 68 can be opened to such an extent that the blowing nozzle 11 can sufficiently enter by only the gas ejected from the blowing nozzle 11, the opening device 29 need not necessarily be provided.

Figure 6:
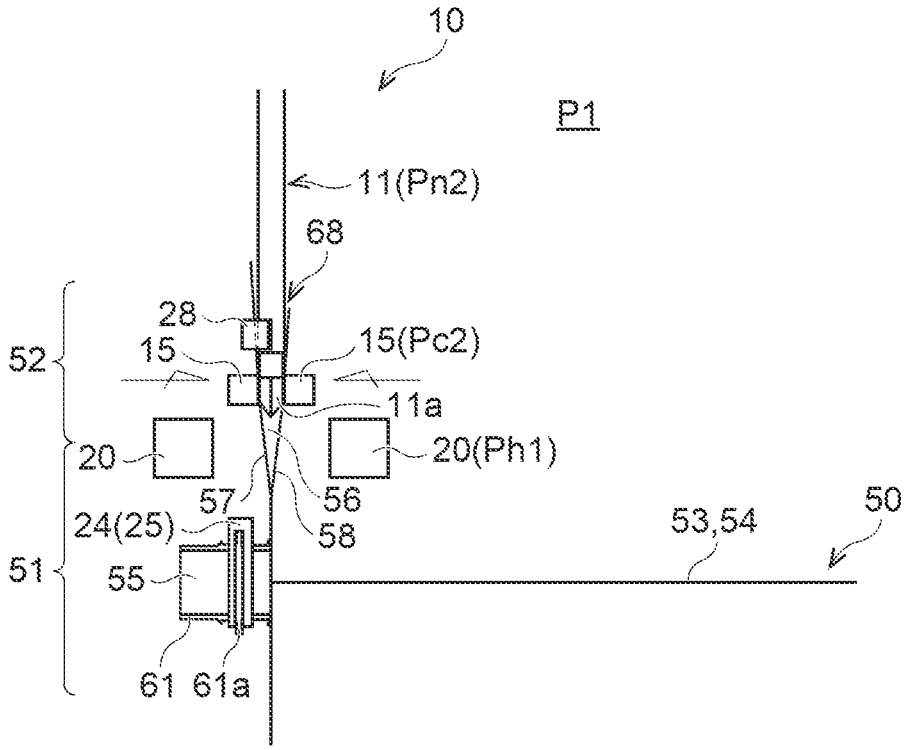
FIG. 6 is a diagram showing an example of a gas filling method.

In a state where the blowing nozzle 11 is arranged at the nozzle blowing position Pn2, each pinching member 15 is moved from the pinching evacuation position Pc1 and is arranged at the pinching support position Pc2 shown in FIG. 6. As a result, in the gas blowing processing position P1, the blowing nozzle 11 located in the gas guide path 56 is sandwiched and supported by the pair of pinching members 15 from the outside of the bag 50 (in particular, of the protruding portion 52). As a result, the space between the bag 50 (that is, the front side film member 57 and the rear side film member 58) and the blowing nozzle 11 (in particular, the nozzle tip portion 11*a*) is reduced and gas leakage through the space can be suppressed. Further, it is possible to prevent the position shift between the blowing nozzle 11 (in particular, the nozzle tip portion 11*a*) and the bag 50.

Figure 7:
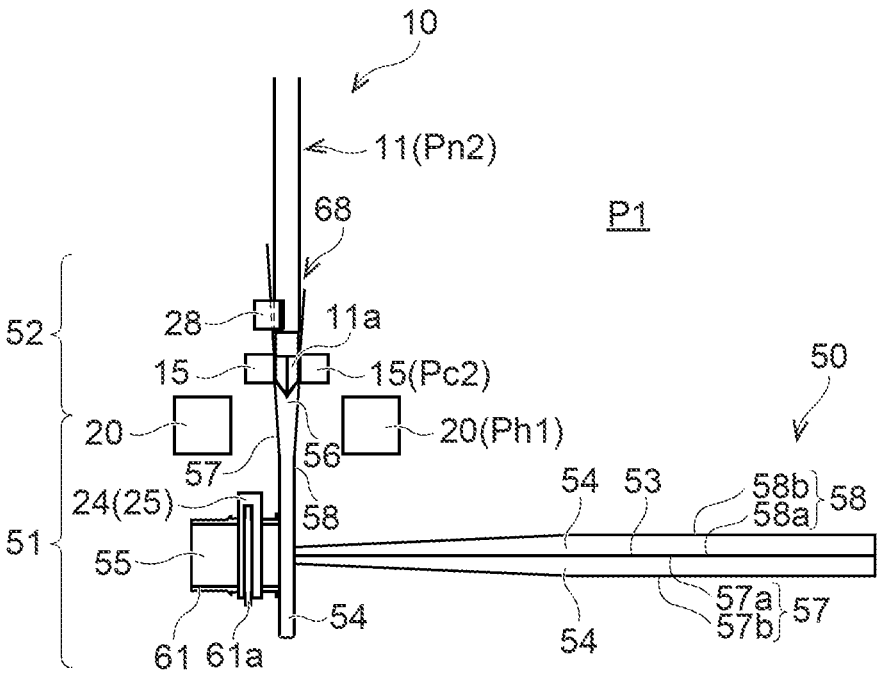
FIG. 7 is a diagram showing an example of a gas filling method.

Then, in the gas blowing processing position P1, a gas is ejected from the blowing nozzle 11 in a state where the blowing nozzle 11 is sandwiched and supported by the pair of pinching members 15 via the bag 50, so that the gas is sent into the gas accommodation portion 54. As a result, the gas accommodation portion 54 swells as shown in FIG. 7. In this process, the gas ejected from the blowing nozzle 11 has a high pressure (that is, the first regulation gas pressure).

Figure 8:
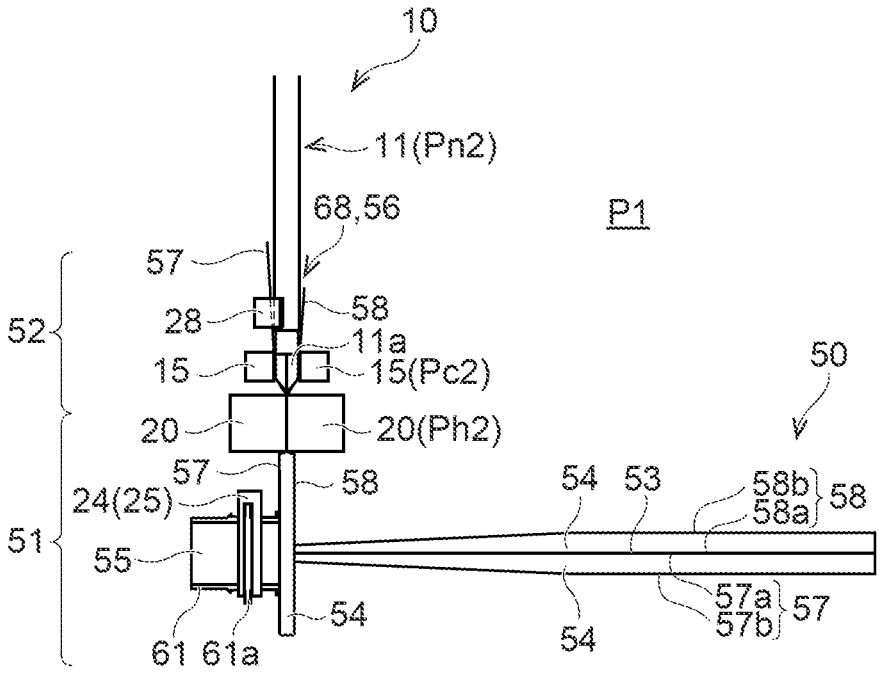
FIG. 8 is a diagram showing an example of a gas filling method.
Figure 9:
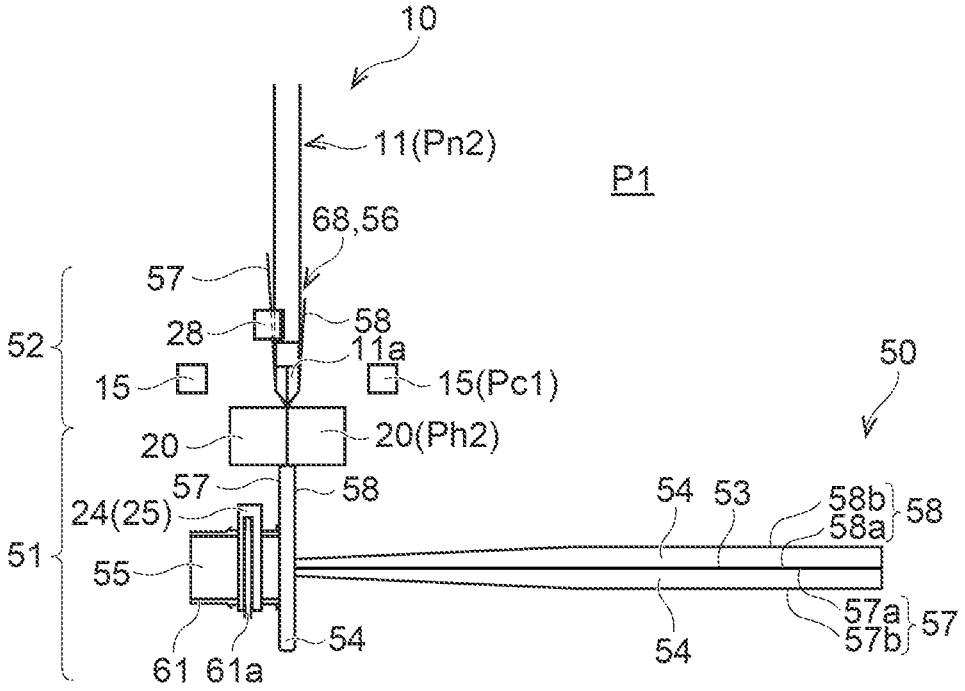
FIG. 9 is a diagram showing an example of a gas filling method.
Figure 10:
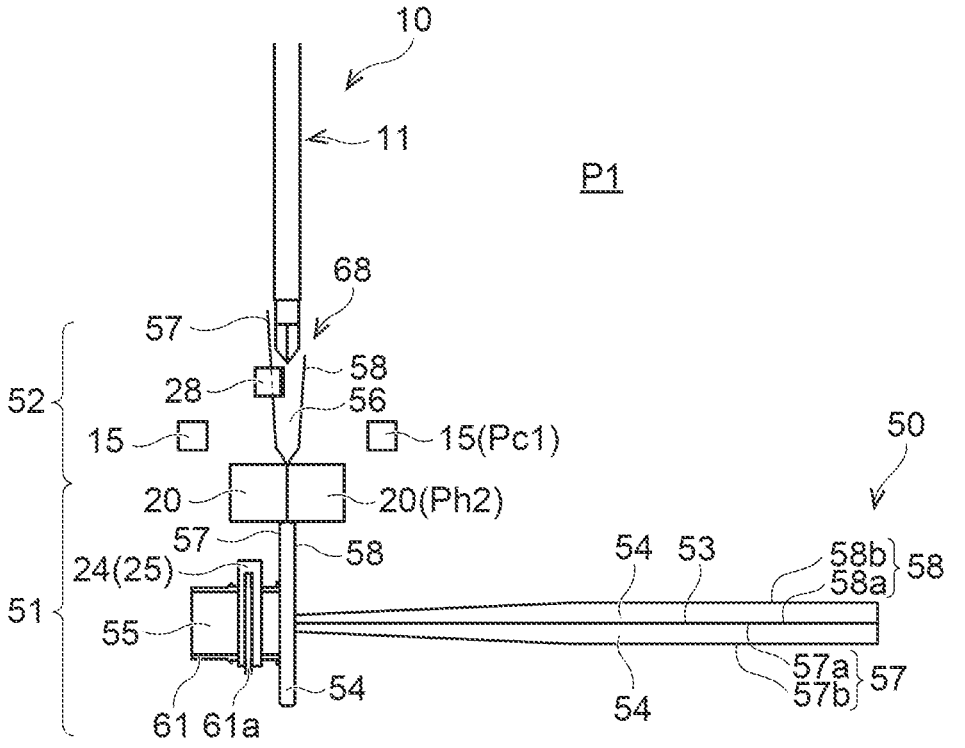
FIG. 10 is a diagram showing an example of a gas filling method.

Then, in the gas blowing processing position P1, the gas accommodation portion 54 is closed by the closure device 20 as shown in FIG. 8 in a state where the gas is filled in the gas accommodation portion 54 so as to have a sufficient pressure while the blowing nozzle 11 is located in the gas guide path 56. In the example shown in the drawing, the two sealing members of the closure device 20 join the front side film member 57 and the rear side film member 58 in an airtight manner in both the main body portion 51 and the protruding portion 52. By forming a joint portion S (see FIG. 11) in both the main body portion 51 and the protruding portion 52 of a bag 50 in this way, the state in which the gas is enclosed in the gas accommodation portion 54 can be appropriately maintained even if the protruding portion 52 is cut off from the main body portion 51 in a later step.

From the viewpoint of properly filling the gas accommodation portion 54 with the gas, it is preferable to continue the gas ejection from the blowing nozzle 11 at least until the closure device 20 completes the closing of the gas guide path 56. After the closure device 20 completes the closure of the gas guide path 56, the ejection of the gas from the blowing nozzle 11 may be continued or stopped.

Figure 11:
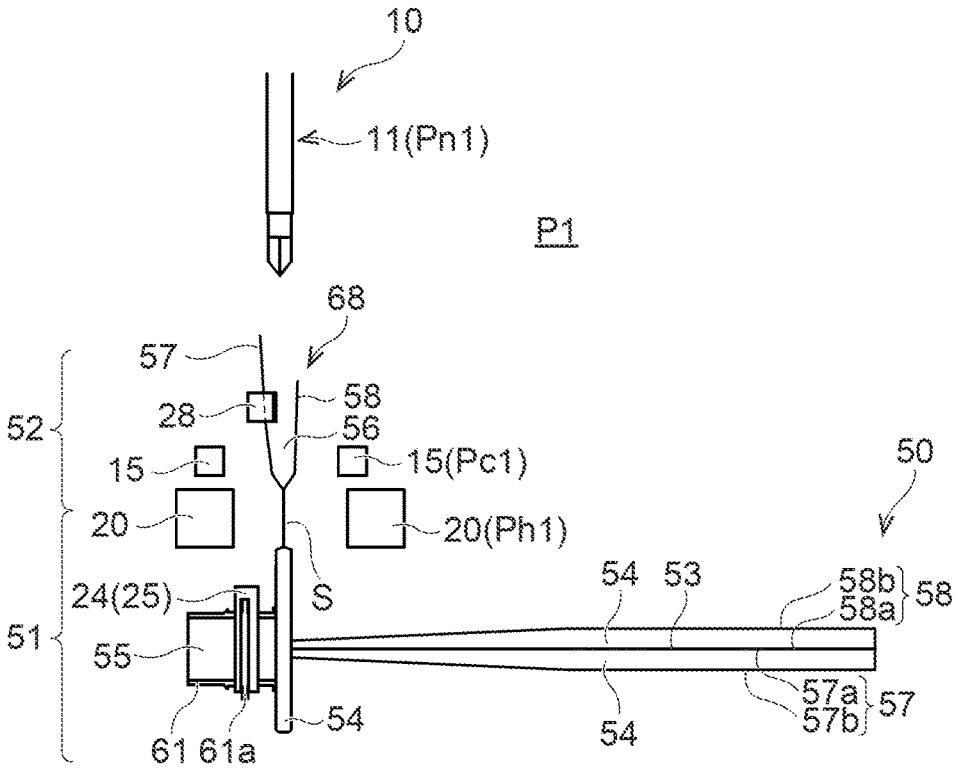
FIG. 11 is a diagram showing an example of a gas filling method.

After that, the pinching members 15 are moved to the pinching evacuation position Pc1 (see FIG. 9), the blowing nozzle 11 is moved to the nozzle evacuation position Pn1 (see FIGS. 10 and 11), and the closure device 20 is moved to the closure evacuation position Ph1 (see FIG. 11).

A bag 50 of which the gas is enclosed in the gas accommodation portion 54 in this manner may be sent to a subsequent stage by the bag transfer mechanism 25 or may be subjected to another treatment (for example, a treatment where contents are introduced into the content accommodation portion 53) in the gas blowing processing position P1.

Pressure Adjustment Mechanism for Ejected Gas

Next, one example of a gas supply device that supplies a gas to the blowing nozzle 11 will be described.

Figure 12:
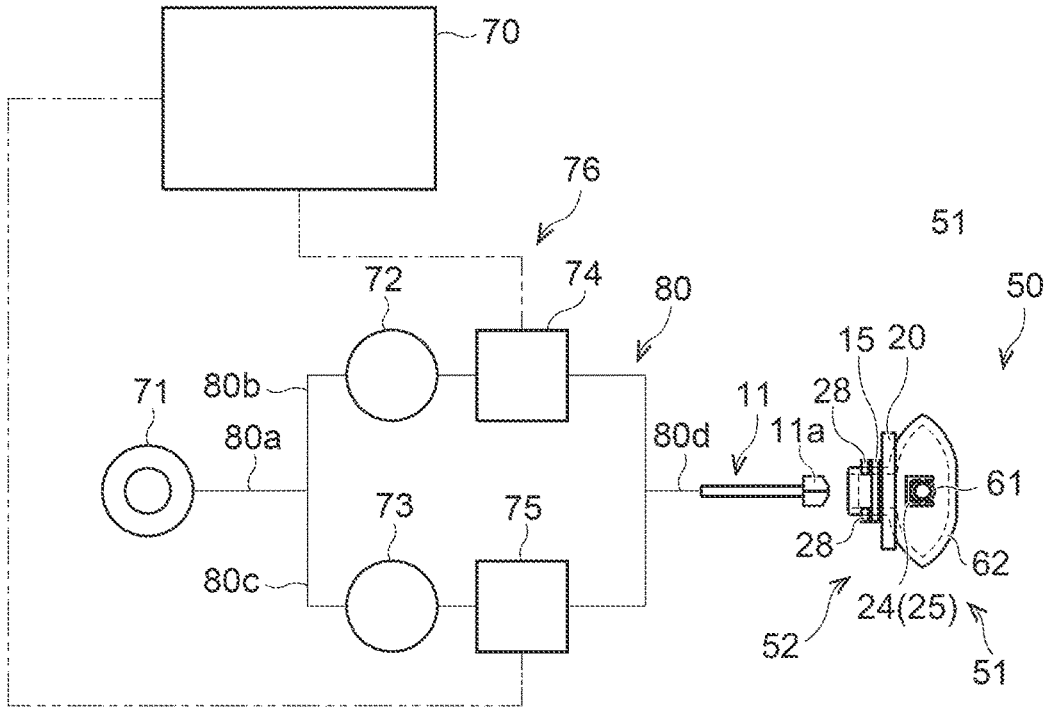
FIG. 12 is a circuit diagram showing an example of a gas supply device that supplies a gas to a blowing nozzle.

FIG. 12 is a circuit diagram showing one example of a gas supply device that supplies a gas to the blowing nozzle 11.

The gas supply device of the present embodiment includes: a gas pipe 80 that supplies a gas to the blowing nozzle 11; a gas supply source 71 that supplies a compressed gas to the gas pipe 80; and a pressure adjustment device 76 that adjusts the pressure of a gas flowing through the gas pipe 80.

The gas pipe 80 includes: an upstream gas pipe 80*a* connected to the gas supply source 71; a downstream gas pipe 80*d* connected to the blowing nozzle 11; and a first branch gas pipe 80*b* and a second branch gas pipe 80*c* which are connected in parallel to each of the upstream gas pipe 80*a* and the downstream gas pipe 80*d*.

The pressure adjustment device 76 shown in FIG. 12 includes: a first pressure regulator 72 and a first on-off valve device 74 attached to the first branch gas pipe 80*b*; and a second pressure regulator 73 and a second on-off valve device 75 attached to the second branch gas pipe 80*c*.

The first pressure regulator 72 adjusts the pressure of the gas flowing through the first branch gas pipe 80*b* to the first regulation gas pressure higher than the environmental pressure (for example, the atmospheric pressure). The second pressure regulator 73 adjusts the pressure of the gas flowing through the second branch gas pipe 80*c* to the second regulation gas pressure which is higher than the environmental pressure and is lower than the first regulation gas pressure. The first on-off valve device 74 opens and closes the flow path of the first branch gas pipe 80*b*. The second on-off valve device 75 opens and closes the flow path of the second branch gas pipe 80*c*. The supply adjustment device that adjusts the supply of a gas to the blowing nozzle 11 by opening and closing the flow path of the gas pipe 80 is configured based on the combination of the first on-off valve device 74 and the second on-off valve device 75.

The gas supply source 71 sends a compressed gas having a pressure higher than the environmental pressure, the first regulation gas pressure and the second regulation gas pressure, to the upstream gas pipe 80*a*. The high-pressure gas sent from the gas supply source 71 to the upstream gas pipe 80*a* is adjusted to the first regulation gas pressure and the second regulation gas pressure in the first pressure regulator 72 and the second pressure regulator 73, respectively, and after that, flows downstream. The first pressure regulator 72 and the second pressure regulator 73 may have an arbitrary configuration which can adjust the pressure of the supplied gas to a desired pressure. The first pressure regulator 72 and the second pressure regulator 73 of the present example are configured by devices that reduce the pressure of the supplied gas to a desired pressure. However, when the pressure of the gas sent from the gas supply source 71 to the upstream gas pipe 80*a* is lower than the first regulation gas pressure and the second regulation gas pressure, the first pressure regulator 72 and the second pressure regulator 73 may be configured by devices that raise the pressure of the supplied gas to a desired pressure.

The first on-off valve device 74 and the second on-off valve device 75 are electrically connected to an ejection pressure control device 70. The first on-off valve device 74 and the second on-off valve device 75 open and close the flow paths of the first branch gas pipe 80*b* and the second branch gas pipe 80*c*, respectively, under the control of the ejection pressure control device 70.

When the pressure of the gas ejected from the blowing nozzle 11 is adjusted to the above-mentioned first regulation gas pressure, the ejection pressure control device 70 places the first on-off valve device 74 in an open condition and places the second on-off valve device 75 in a closed condition. As a result, basically, a gas is not actively sent from the second branch gas pipe 80*c* to the downstream gas pipe 80*d*, and a gas with a pressure having been adjusted by the first pressure regulator 72 flows from the first branch gas pipe 80*b* into the downstream gas pipe 80*d* and is supplied to the blowing nozzle 11.

On the other hand, when the pressure of a gas ejected from the blowing nozzle 11 is adjusted to the above-mentioned second regulation gas pressure, the ejection pressure control device 70 places the first on-off valve device 74 in a closed condition and places the second on-off valve device 75 in an open condition. As a result, basically, a gas is not actively sent from the first branch gas pipe 80*b* to the downstream gas pipe 80*d*, and a gas with a pressure having been adjusted by the second pressure regulator 73 flows from the second branch gas pipe 80*c* into the downstream gas pipe 80*d* and is supplied to the blowing nozzle 11.

As described above, according to the gas filling apparatus 10 and the gas filling method of the present embodiment, the blowing nozzle 11 can be smoothly and highly accurately arranged in the gas guide path 56 and can eject a high-pressure gas in the gas guide path 56. As a result, the gas accommodation portion 54 can be filled with a high-pressure gas reliably and quickly, and the high-pressure gas can be enclosed in the gas accommodation portion 54 by closing the gas guide path 56 in an airtight manner.

Further, a bag 50 of the present embodiment has a structure suitable for a process of enclosing a gas in the gas accommodation portion 54, and the above-described gas filling apparatus 10 and gas filling method can enclose a gas having a desired pressure in the gas accommodation portion 54 quickly and reliably.

First Modification Example

Figure 13:
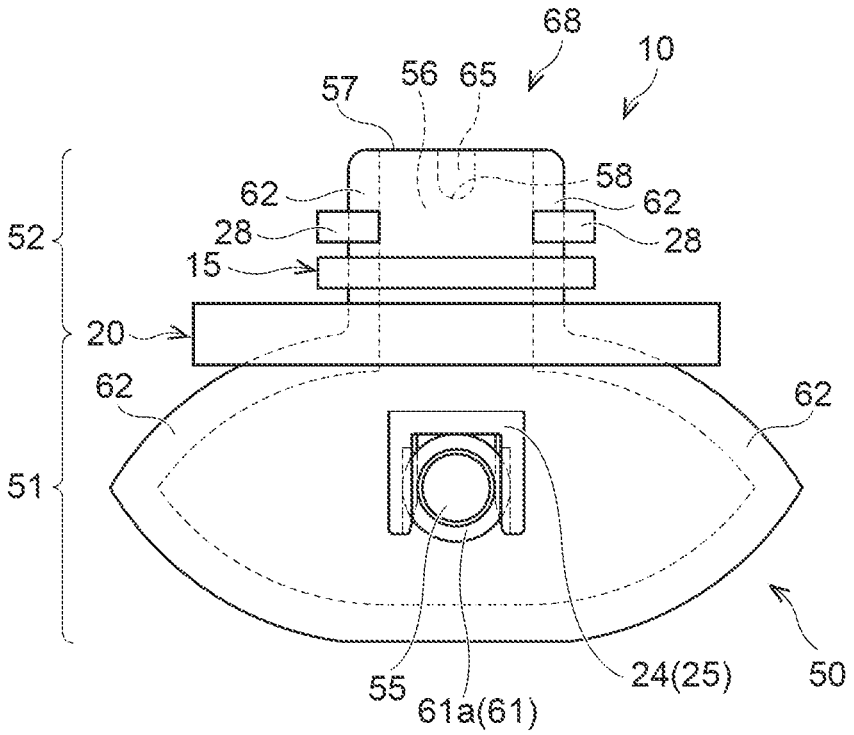
FIG. 13 is a diagram showing a schematic configuration of a first modification example of a bag.

FIG. 13 is a diagram showing a schematic configuration of a first modification example of a bag 50. In FIG. 13, a part of the elements (for example, the blowing nozzle 11 and the like) constituting the gas filling apparatus 10 is not shown.

The shape of the notch portion 65 included in a bag 50 is not limited to the above-mentioned square shape (see FIGS. 1 and 2) and the notch portion 65 may have an arbitrary shape. The notch portion 65 shown in FIG. 13 has a shape based on the combination of a rectangle and a semicircle are combined.

It is preferable that the blowing nozzle 11 (in particular, the nozzle tip portion 11*a* (at least a part including the tip end side portion)) have a shape and a size such that the blowing nozzle 11 can pass through the notch portion 65. As described above, it is preferable that the blowing nozzle 11 push the front side film member 57 in such a manner that the front side film member 57 moves away from the rear side film member 58 in order to open the opening section 68 prior to inserting the blowing nozzle 11 into the gas guide path 56 (see FIGS. 3 and 4). In order to achieve this, the blowing nozzle 11 moves so as to pass through the notch portion 65 and to push the part of the front side film member 57 which is exposed from the notch portion 65, so that the front side film member 57 can be moved away from the rear side film member 58.

The opening device 29 (see FIG. 4) may hold the rear side film member 58 while not covering the notch portion 65 or may hold the rear side film member 58 while covering the notch portion 65. When the opening device 29 uses negative pressure to hold the rear side film member 58, it is preferable that the opening device 29 (for example, the suction cup described above) hold the rear side film member 58 while not covering the notch portion 65.

Other Modification Examples

The present disclosure is not limited to the above-described embodiments and modification examples. For example, various modifications may be added to each element of the above-described embodiments and modification examples. Further, the configurations of the above-described embodiments and modification examples may be combined in whole or in part.

For example, in the above-described embodiments, the blowing nozzle 11 moves from the first nozzle evacuation position Pn1-*a* (see FIG. 3) to the second nozzle evacuation position Pn1-*b* (see FIG. 4) via a notch portion 65, so that the opening of the opening section 68 of the gas accommodation portion 54 is urged. If the opening section 68 can be sufficiently opened only by a gas ejected from the blowing nozzle 11, each bag 50 does not have to have a notch portion 65.

The strength of the pressure of a gas ejected from the blowing nozzle 11 is switched in two steps (that is, the first regulation gas pressure and the second regulation gas pressure) in the above-described embodiments but may be switched in three or more steps or may be only in one step.

In the above-described embodiments, the gas accommodation portion 54 is provided only in the main body portion 51 of a bag 50, but the gas accommodation portion 54 may be provided in both the main body portion 51 and the protruding portion 52. In this case, the closure device 20 may join the front side film member 57 and the rear side film member 58, in an airtight manner, at a position of the protruding portion 52 away from the main body portion 51 in such a manner that the communication between the gas accommodation portion 54 and the gas guide path 56 is shut down.

In a bag 50, the relative arrangement relation between the content accommodation portion 53 and the gas accommodation portion 54 is not limited. For example, as in the self-support pouch disclosed in Japanese patent application publication No. 2015-24855, the content accommodation portion 53 may be located outside the gas accommodation portion 54. Even in cases where the content accommodation portion 53 is not located inside the gas accommodation portion 54, a gas having a desired pressure can be quickly enclosed in the gas accommodation portion 54 by using the above-mentioned gas filling method and the gas filling apparatus 10. As described above, the above-mentioned gas filling methods and gas filling apparatuses 10 can be widely applied to bags 50 each including a content accommodation portion 53 and a gas accommodation portion 54 in various forms.

The invention claimed is:

1. A gas filling method of enclosing a gas in a gas accommodation portion of a bag comprising a content accommodation portion and the gas accommodation portion, the gas filling method including the steps of:

transferring the bag in an intermittent manner to arrange the bag at a gas blowing processing position;

inserting a blowing nozzle into a gas guide path of the bag in the gas blowing processing position, the gas guide path being communicated with the gas accommodation portion;

pinching the blowing nozzle arranged in the gas guide path from outside of the bag with a pair of pinching members in the gas blowing processing position;

causing the blowing nozzle to eject the gas in a state where the blowing nozzle is pinched via the bag by the pair of pinching members in the gas blowing processing position in such a manner that the gas is sent to the gas accommodation portion; and closing the gas accommodation portion in an airtight manner in the gas blowing processing position in a state where the blowing nozzle is arranged in the gas guide path, wherein the step of inserting the blowing nozzle into the gas guide path includes the steps of:

causing the blowing nozzle to move a front side film member away from a rear side film member while contacting the front side film member protruding from the rear side film member, in such a manner that an opening section of the gas guide path formed by the front side film member and the rear side film member is opened; and inserting the blowing nozzle into the gas guide path via the opening section.

2. The gas filling method as defined in claim 1, wherein the blowing nozzle is inserted into the gas guide path while movement of a film member of the bag that forms the gas guide path is restricted by a restricting member.

3. A gas filling apparatus that encloses a gas in a gas accommodation portion of a bag including a content accommodation portion and the gas accommodation portion, the gas filling apparatus comprising:

a bag transfer mechanism that transfers the bag in an intermittent manner;

a blowing nozzle that ejects the gas;

a nozzle movement mechanism that arranges the blowing nozzle at a nozzle evacuation position and at a nozzle blowing position, the blowing nozzle arranged at the nozzle evacuation position being not located in a gas guide path communicated with the gas accommodation portion of the bag, the blowing nozzle arranged at the nozzle blowing position being located in the gas guide path;

a pair of pinching members;

a pinching movement mechanism that arranges the pair of pinching members at a pinching evacuation position and at a pinching support position, the pair of pinching members arranged at the pinching evacuation position not supporting the blowing nozzle located in the gas guide path from outside of the bag, the pair of pinching members arranged at the pinching support position pinching and supporting the blowing nozzle located in the gas guide path from outside of the bag;

a closure device that closes the gas accommodation portion in an airtight manner; and a restricting member that restricts movement of a film member of the bag forming the gas guide path, wherein the nozzle movement mechanism moves the blowing nozzle from the nozzle evacuation position to the nozzle blowing position so that: the blowing nozzle moves a front side film member away from a rear side film member while contacting the front side film member protruding from the rear side film member, in such a manner that an opening section of the gas guide path formed by the front side film member and the rear side film member is opened; and the blowing nozzle is inserted into the gas guide path via the opening section.

4. The gas filling apparatus as defined in claim 3, wherein the bag includes: a main body portion; and a protruding portion protruding from the main body portion, wherein the main body portion includes: the content accommodation portion; the gas accommodation portion; and a content guide path that is communicated with an outside and the content accommodation portion, and wherein the protruding portion includes the gas guide path communicated with an outside and the gas accommodation portion.

5. The gas filling apparatus as defined in claim 3, comprising a closure movement mechanism that moves the closure device to an airtight closure position and to a closure evacuation position, the closure device arranged in the airtight closure position being in contact with the bag to close the gas accommodation portion in an airtight manner, the closure device arranged in the closure evacuation position being distanced from the bag not to close the gas accommodation portion in an airtight manner.

6. The gas filling apparatus as defined in claim 5, wherein the bag includes: a main body portion; and a protruding portion protruding from the main body portion, wherein the main body portion includes: the content accommodation portion; the gas accommodation portion; and a content guide path that is communicated with an outside and the content accommodation portion, and wherein the protruding portion includes the gas guide path communicated with an outside and the gas accommodation portion.

7. The gas filling apparatus as defined in claim 3, wherein the blowing nozzle has a tip portion with a flat shape.

8. The gas filling apparatus as defined in claim 7, wherein the bag includes: a main body portion; and a protruding portion protruding from the main body portion, wherein the main body portion includes: the content accommodation portion; the gas accommodation portion; and a content guide path that is communicated with an outside and the content accommodation portion, and wherein the protruding portion includes the gas guide path communicated with an outside and the gas accommodation portion.

9. The gas filling apparatus as defined in claim 7, comprising a closure movement mechanism that moves the closure device to an airtight closure position and to a closure evacuation position, the closure device arranged in the airtight closure position being in contact with the bag to close the gas accommodation portion in an airtight manner, the closure device arranged in the closure evacuation position being distanced from the bag not to close the gas accommodation portion in an airtight manner.

10. The gas filling apparatus as defined in claim 9, wherein the bag includes: a main body portion; and a protruding portion protruding from the main body portion, wherein the main body portion includes: the content accommodation portion; the gas accommodation portion; and a content guide path that is communicated with an outside and the content accommodation portion, and wherein the protruding portion includes the gas guide path communicated with an outside and the gas accommodation portion.

* * * * *